United States Patent [19]

Onozuka et al.

[11] Patent Number: 4,958,836

[45] Date of Patent: Sep. 25, 1990

[54] GOLF SIMULATOR

[75] Inventors: Kuniharu Onozuka, Kanagawa; Takashi Yoshino, Tokyo, both of Japan

[73] Assignee: Sony Corporation, Tokyo, Japan

[21] Appl. No.: 451,149

[22] Filed: Dec. 15, 1989

[30] Foreign Application Priority Data

Dec. 27, 1988 [JP] Japan ..... 63-329682

[51] Int. Cl.[5] ..... A63B 69/36

[52] U.S. Cl. ..... 273/184 R; 273/184 B; 273/185 R; 273/185 A; 273/185 D; 273/186 R; 273/204

[58] Field of Search ..... 273/183 R, 183 A, 184 R, 273/184 B, 185 R, 185 A, 185 B, 185 C, 185 D, 186 R, 186 B, 186 C, 195 R, 196, 197 R, 197 A, 204, 208, 87 R

[56] References Cited

U.S. PATENT DOCUMENTS

| | | | |
|---|---|---|---|
| 2,715,338 | 8/1955 | Simjian | 273/185 A |
| 3,601,408 | 8/1971 | Wright | 273/185 D |
| 4,254,956 | 3/1981 | Rusnak | 273/186 R |
| 4,306,722 | 12/1981 | Rusnak | 273/186 R |
| 4,767,121 | 8/1988 | Tonner | 273/185 |
| 4,848,769 | 7/1989 | Bell et al. | 273/184 B |

FOREIGN PATENT DOCUMENTS

| | | | |
|---|---|---|---|
| 1595791 | 8/1981 | United Kingdom | 273/185 A |

*Primary Examiner*—Edward M. Coven
*Assistant Examiner*—Jessica J. Harrison
*Attorney, Agent, or Firm*—Ronald P. Kananen

[57] ABSTRACT

In a golf simulator having a housing in which a display and a reproducing device are accommodated, and an arm to the distal end of which a ball is secured, the golf simulator comprises a bed plate which supports a horizontal shaft; a swingable bed rotatable on the horizontal shaft and having another shaft which makes a right angle with the horizontal shaft, and to which the proximal end of the arm is rotatably secured; and drive means for driving the swingable bed so as to enable the shaft of the swingable bed to be selectively in either of a first state in which the shaft inclines with respect to the vertical line and toward approaching to the front side of the housing, and a second state in which the shaft inclines with respect to the vertical line and in the reverse of inclination under the first state.

9 Claims, 14 Drawing Sheets

GOLF SIMULATOR

BACKGROUND OF THE INVENTION

1. Field of the Invention

This invention relates generally to a golf simulator, and more particularly to a golf simulator which has a ball secured to the distal end of an arm which is rotatable on the proximal end thereof.

2. Description of the Prior Art

A so-called golf simulator, for example disclosed in U.S. Pat. No. 4,767,121, has a ball secured to the distal end of a rotatable arm which is capable of being struck in practice with a golf club. In a golf simulator of this kind, further designed to be able to begin a play when a coin or the like is inserted, it is necessary to move the arm from a ball-struck position, where the ball can be struck, to a ball-stored position where the ball can not be struck after the play is finished.

To solve the problem, if a gear is attached to the arm, and driven by a motor used only for rotating the gear in order to move the arm from the ball-struck position to the ball-stored position, the device for moving the arm becomes complicated, and the part of the device and the steps required to the assembly increase, so that the manufacturing cost increases.

OBJECTS AND SUMMARY OF THE INVENTION

Accordingly, it is an object of the present invention to provide a golf simulator in which a ball secured to the distal end of an arm can be moved from a ball-struck position to a ball-stored position with a simple device.

Another object of the invention is to provide a golf simulator in which the height of a ball secured to the distal end of an arm can be accurately adjusted.

A further object of the invention is to provide a golf simulator in which a backlash is not caused between an arm, to the distal end of which a ball is secured, and a shaft, by which the rotatable arm is supported.

In accordance with an aspect of this invention, in a golf simulator having a housing in which a display and a reproducing device are accommodated, and an arm to the distal end of which a ball is secured, the golf simulator comprises a bed plate which supports a horizontal shaft; a swingable bed rotatable on the horizontal shaft, and having another shaft which makes a right angle with the horizontal shaft to which the proximal end of the arm is rotatably secured; and drive means for driving the swingable bed so as to enable the swingable bed to be positioned selectively in either of a first state in which the arm slants toward spacing downwardly from the horizontal line at the distal end thereof due to a forward inclination of the shaft of the swingable bed with respect to the vertical line, and slants toward approaching to the front side of the housing, and a second state in which the arm slants toward spacing upwardly from the horizontal line at the distal end thereof due to backward inclination of the shaft of the swingable bed with respect to the vertical line.

Another aspect of the golf simulator of the invention which has a housing in which a display and a reproducing device are accommodated and an arm to the distal end of which a ball is secured, comprises a bed plate which supports a horizontal shaft; a swingable bed rotatable on the horizontal shaft, and having a worm wheel and another shaft which makes a right angle with the horizontal shaft and to which the proximal end of the arm is rotatably secured; and drive means having a worm meshed with the worm wheel, and moving the swingable bed selectively to be in a first state in which the shaft of the swingable bed inclines with respect to the vertical line and toward approaching to the front side of the housing, and a second state in which the shaft of the swingable bed inclines with respect to the vertical line and in the reverse of inclination under the first state.

A further aspect of golf simulator of the invention, which has a housing in which a display and a reproducing device are accommodated, and an arm to the distal end of which a ball is secured, comprises a bed plate which supports a horizontal shaft; a swingable bed rotatable on the horizontal having a detected element and another shaft which makes a right angle with the horizontal shaft and to which the proximal end of the arm is rotatably secured; a sensor secured to a portion, near the detected element, of the bed plate; and drive means for driving the swingable bed on an signal from the sensor so as to enable the shaft of the swingable bed to be positioned selectively in each of three positions—a first position, a second position and a third position—which correspond in turn to three angles—a first angle, a second angle and a third angle—which are formed between the shaft and the vertical line and toward making the shaft approach the front side of the housing.

Still a further golf embodiment of the simulator of the invention, which has a housing in which a display and a reproducing device are accommodated, and an arm to the distal end of which a ball is secured, comprises a bed plate which supports a horizontal shaft; a swingable bed rotatable on the horizontal shaft, and having another shaft which make a right angle with the horizontal shaft and to which the proximal end of the arm is rotatably secured; drive means for driving the swingable bed so as to enable the shaft of the swingable bed to be positioned selectively in either of a first state in which the shaft inclines with respect to the vertical line and toward approaching to the front side of the housing, and a second state in which the shaft inclines in the reverse of inclination under the first state, wherein the proximal end of the arm has a shape of hollow cylinder in the inner periphery of which a groove is provided; the shaft of the swingable bed has a projection on the outer periphery thereof; and the shaft is fitted into the proximal end of the arm so as to enable the projection of the shaft to engage with the groove of the arm.

DETAILED DESCRIPTION OF PREFERRED EMBODIMENTS

An embodiment of a golf simulator to which the present invention is applied will be described below with reference to the accompanying drawings.

Figure 1:
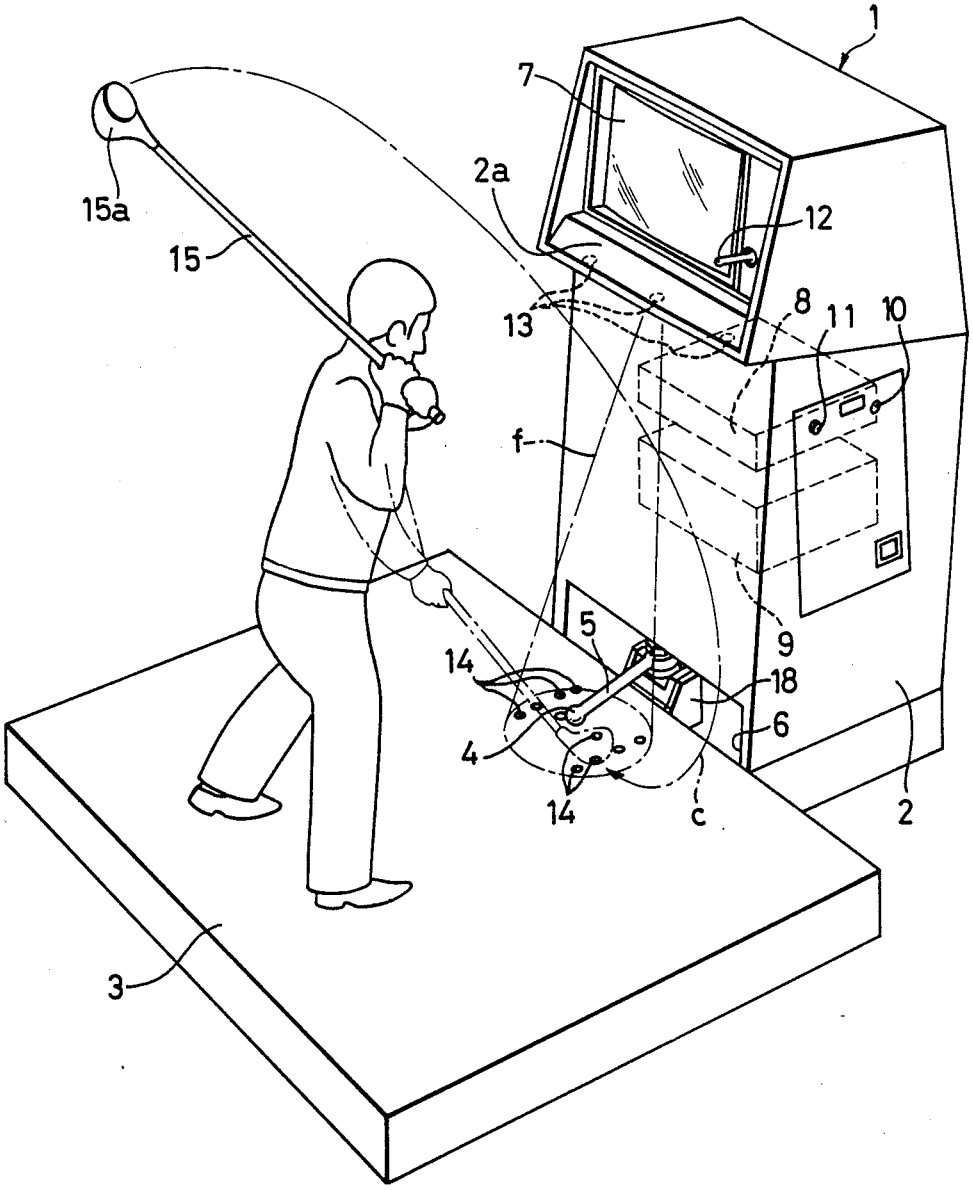
FIG. 1 is a perspective view of a golf simulator according to an embodiment of this invention.

An overall arrangement of a golf simulator 1 will be described first with reference to FIG. 1.

A ball striking base 3 is arranged in front of the lower portion of a body 2 of the golf simulator 1. A rotatable arm 5 having a ball 4 secured to its distal end extends toward a ball-struck position on the ball striking base 3 through an opening 6 formed in the lower portion of the front surface of the body 2. Note that a TV monitor 7 is arranged at the upper portion of the body 2, whereas a reproducing device 8, such as an optical video disk player, a microcomputer 9 and the like are arranged within the body 2. An insertion opening 10 of a coin box, a starting button 11 and the like are arranged on a side surface of the body 2. Cursor operating means 12 are arranged on a side of the front of the TV monitor 7. In addition, a plurality of light emitting elements 13 are arranged on a surface provided at the upper front end 2*a* of the body 2 so as to direct the elements 13 obliquely downward, and a large number of photodetection elements 14 are arranged near the ball 4 on the ball striking base 3.

When the starting button 11 is depressed after a coin is inserted into the insertion opening 10, the microcomputer 9 starts to set the golf simulator 1 in a playable state.

In this case, the arm 5 stored in the body 2 is moved onto the ball striking base 3 through the opening 6, and the ball 4 is located in the ball-struck position. At the same time, the reproducing device 8 is operated to display various program modes on the TV monitor 7.

A player operates the cursor operating means 12 to move a cursor displayed on the TV monitor 7. Thus, the player can select a desired program mode, a club to be used and the like. The player then stands on the ball striking base 3 with a selected golf club 15 in his hands, and actually hits the ball 4 secured to the distal end of the arm 5.

The speed, the direction and so forth of the head 15*a* of the golf club 15 are detected by the optical sensor comprising the plurality of light emitting elements 13 and the large number of photodetection elements 14. The flight path, flight distance and so forth of the ball 4 are displayed on the TV monitor 7 based on the detected result.

Thus, the player practices various types of swings of various golf clubs, a driver to a putter, as he watches pictures on the TV monitor 7. Note that each hole of an actual golf course (1st hole to 18th hole) can be displayed on the TV monitor 7. The player can sequentially practice tee shots with a driver and irons, various shots on a fairway and putting on a putting green in each hole as he watches pictures on the TV monitor 7. Hence, the player can practice various types of swings while enjoying a golf game.

Figure 2:
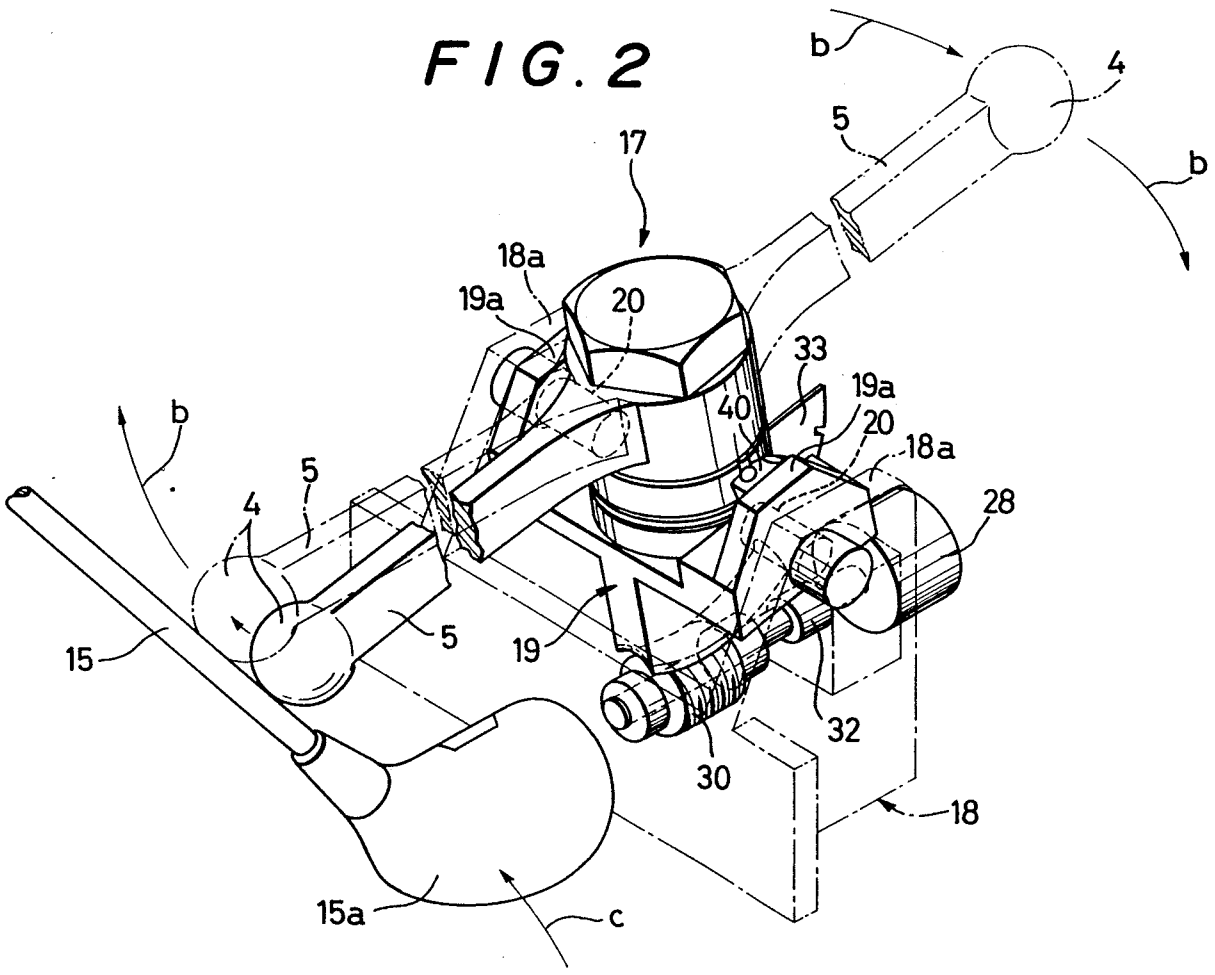
FIG. 2 is a perspective view of a ball-arm supporting device, which partly appears in FIG. 1.
Figure 3:
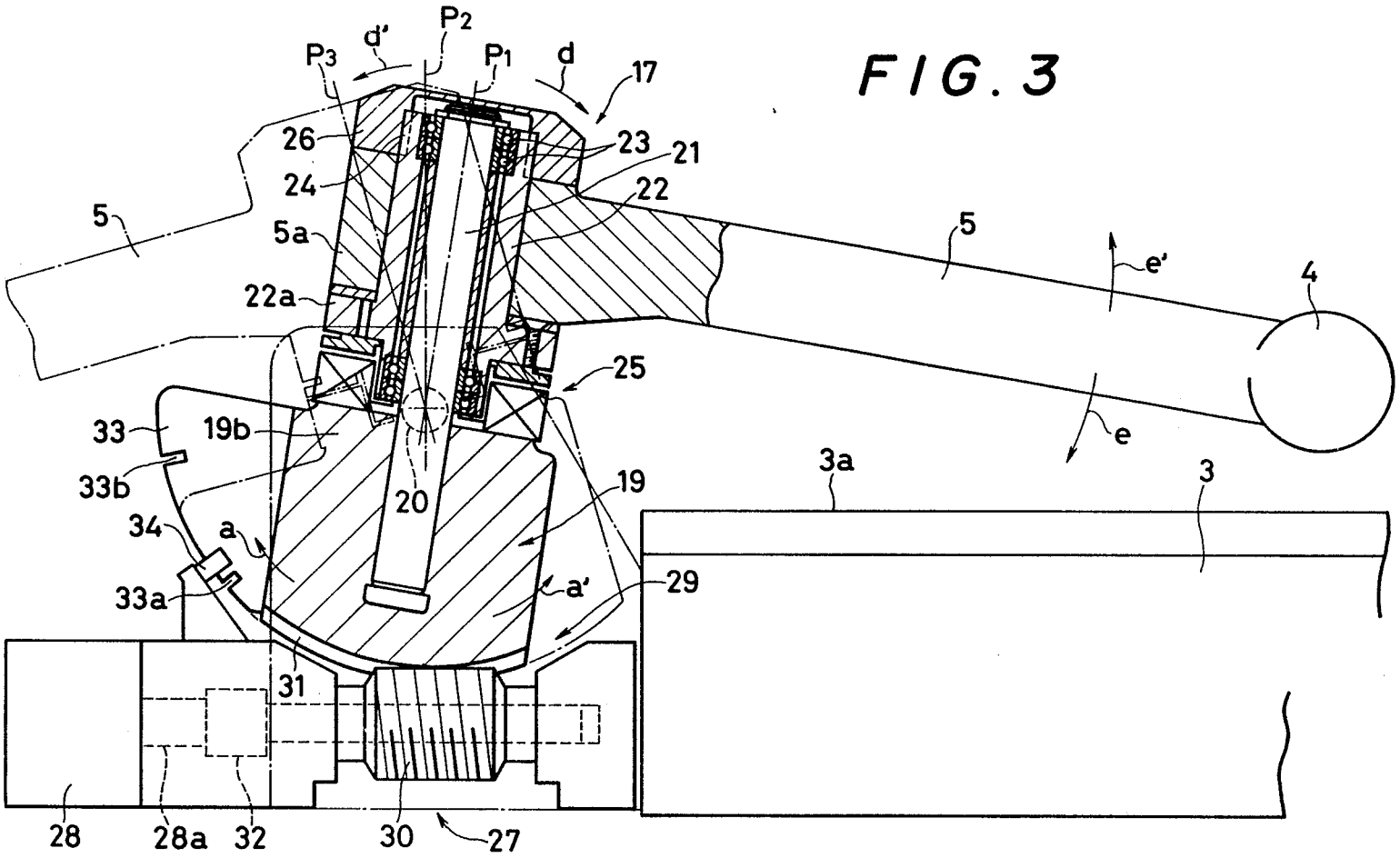
FIG. 3 is a side view, partly broken away and in section, of the ball-arm supporting device of FIG. 2.
Figure 4:
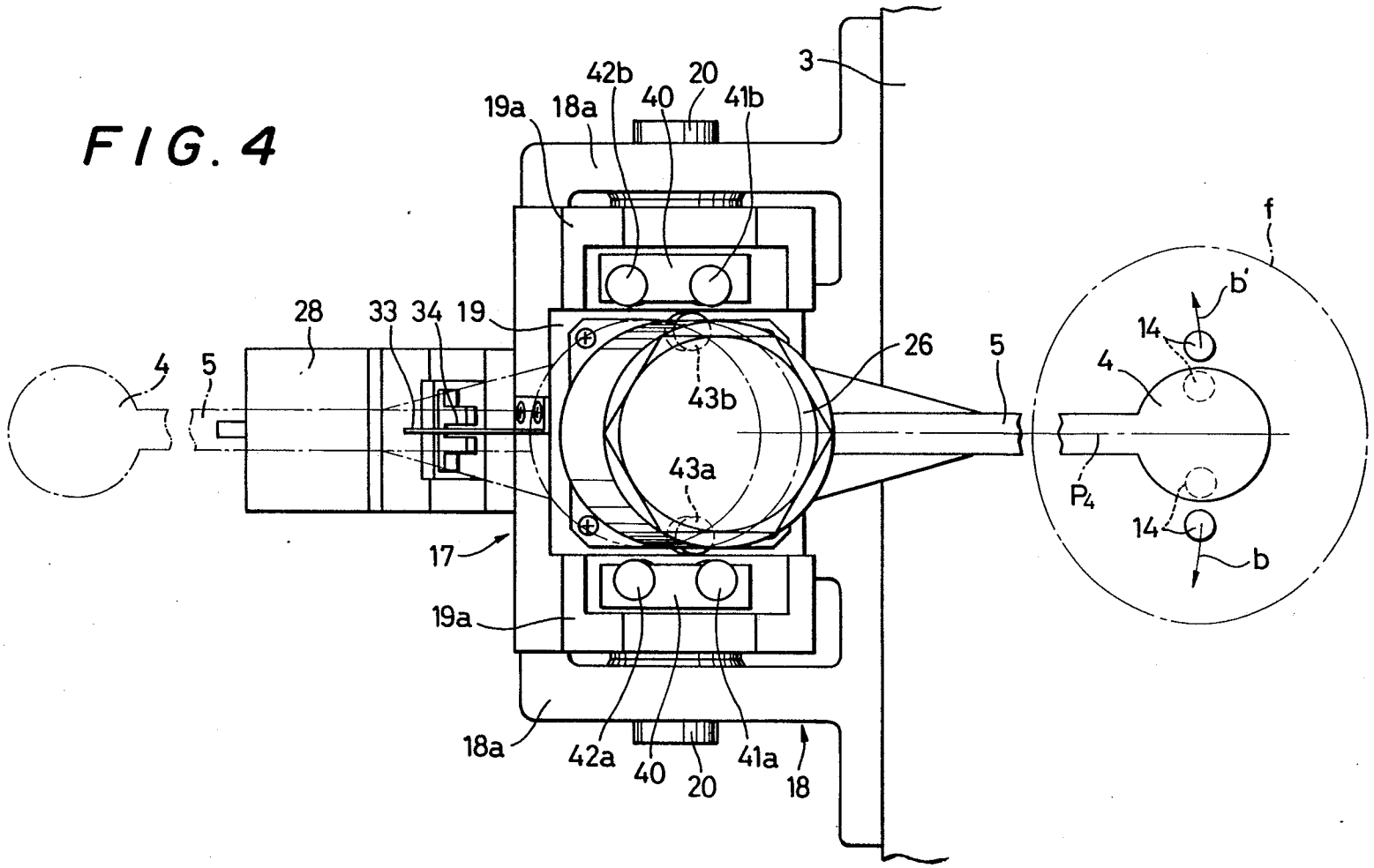
FIG. 4 is a plan view of the ball-arm supporting device of FIG. 2.

The components of the golf simulator 1 will be hereinafter described in detail. Firstly, as shown in FIGS. 2 to 4, a swingable bed 19 of an arm supporting device 17 is arranged between right and left support members 18*a* of a bed plate 18 which are fixed to the body 2. Right and left side portions 19*a* of the swingable bed 19 are supported by a pair of right and left horizontal shafts 20, and the bed 19 is swingable in the direction indicated by arrows a and a'. A vertical shaft 21, perpendicular to the horizontal shafts 20, extends upright on a central portion 19*b* of the swingable bed 19. An arm holder 22 is rotatably supported on the outer periphery of the vertical shaft 21 through a plurality of bearings 23. The arm 5 is detachably mounted on the outer periphery of the arm holder 22 through its cylindrical mounted portion 5*a* which is integrally formed at its proximal end of the arm 5 in opposed relation to the ball 4. The mounted portion 5*a* is fastened to a flange 22*a* of the arm 22 with a nut 26 which is screwed down on a screw 24 provided on the upper end of the arm holder 22, so that the arm 5 is fixed to the arm holder 22. That is, the arm 5 is designed to be rotatable about the vertical shaft 21 in a direction indicated by arrows b and b'. Note that an electromagnetic brake 25, for stopping the arm 22 in the ball-struck position, is arranged between the outer periphery of the lower end of the arm holder 22 and the upper part of the central portion 19*b* of the swingable bed 19.

A drive means 27 for swinging the swingable bed 19 in the direction indicated by the arrows a and a' is arranged under the swingable bed 19. The drive means 27 comprises a stepping motor 28 mounted on the bed plate 18 and a worm gear 29.

The worm 30 of the worm gear 29 is rotatably supported on the bed plate 18, and engages a worm wheel 31 which projects downwards from the central portion 19*b* of the swingable bed 19, and the center of the worm wheel 31 coincides with that of the horizontal shafts 20. The motor shaft 28*a* of the stepping motor 28 is coupled to one end of the worm 30 through a coupling 32. Note that a sectorial plate 33 with slits 33*a* and 33*b* is attached to the rear surface of the worm wheel 30, and an optical sensor 34 for detecting the two slits 33*a* and 33*b*, formed at the outer edge of the plate 33 so as to be spaced from each other, is attached to the bed plate 18.

Thus, when the player hits the ball 4 secured to the distal end of the arm 5, with the golf club 15 in a direction indicated by arrow c in FIG. 2, the arm 5 is rotated together with the arm holder 22 about the vertical shaft 21 in the direction indicated by the arrow b. At that time, if the player is not right-handed but left-handed, the arm 5 is to be rotated in the reverse direction.

When the stepping motor 28 is pulse-controlled by a controlling circuit (to be described later), the swingable bed 19 is rotated by the worm gear 29 driven by the motor 28, around the horizontal shafts 20 in the direction indicated by the arrows a and a'. As the result, the vertical shaft 21 inclines forward or backward with respect to the vertical line in a direction indicated by arrows d and d', and thereby, the height of the arm 5 is adjusted upwardly or downwardly in a direction indicated by arrows e and e' with respect to the ball striking base 3.

Figure 5:
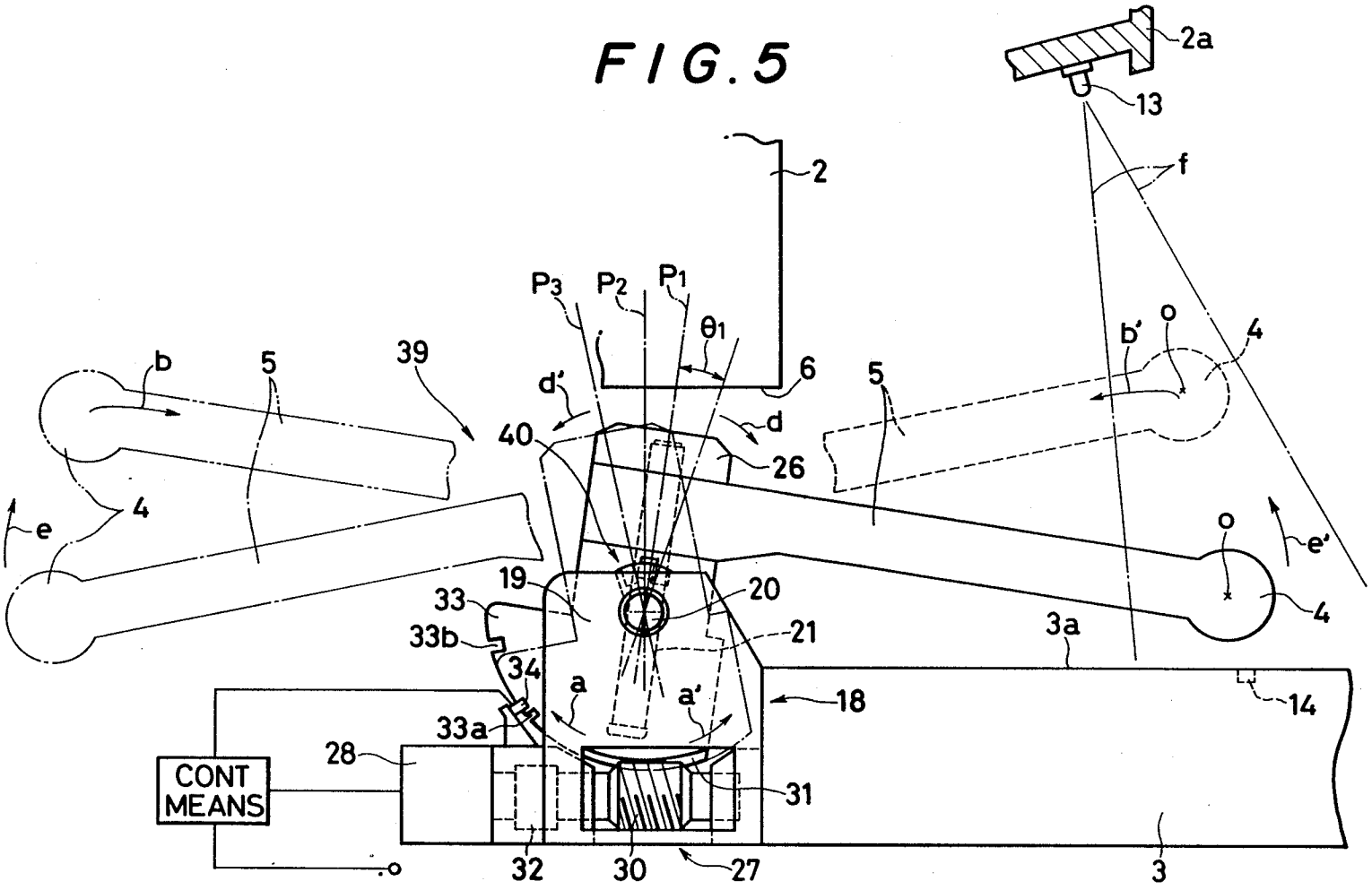
FIG. 5 is a side view of the ball-arm supporting device of FIG. 2, when the ball arm is accommodated in the housing of the golf simulator.
Figure 6:
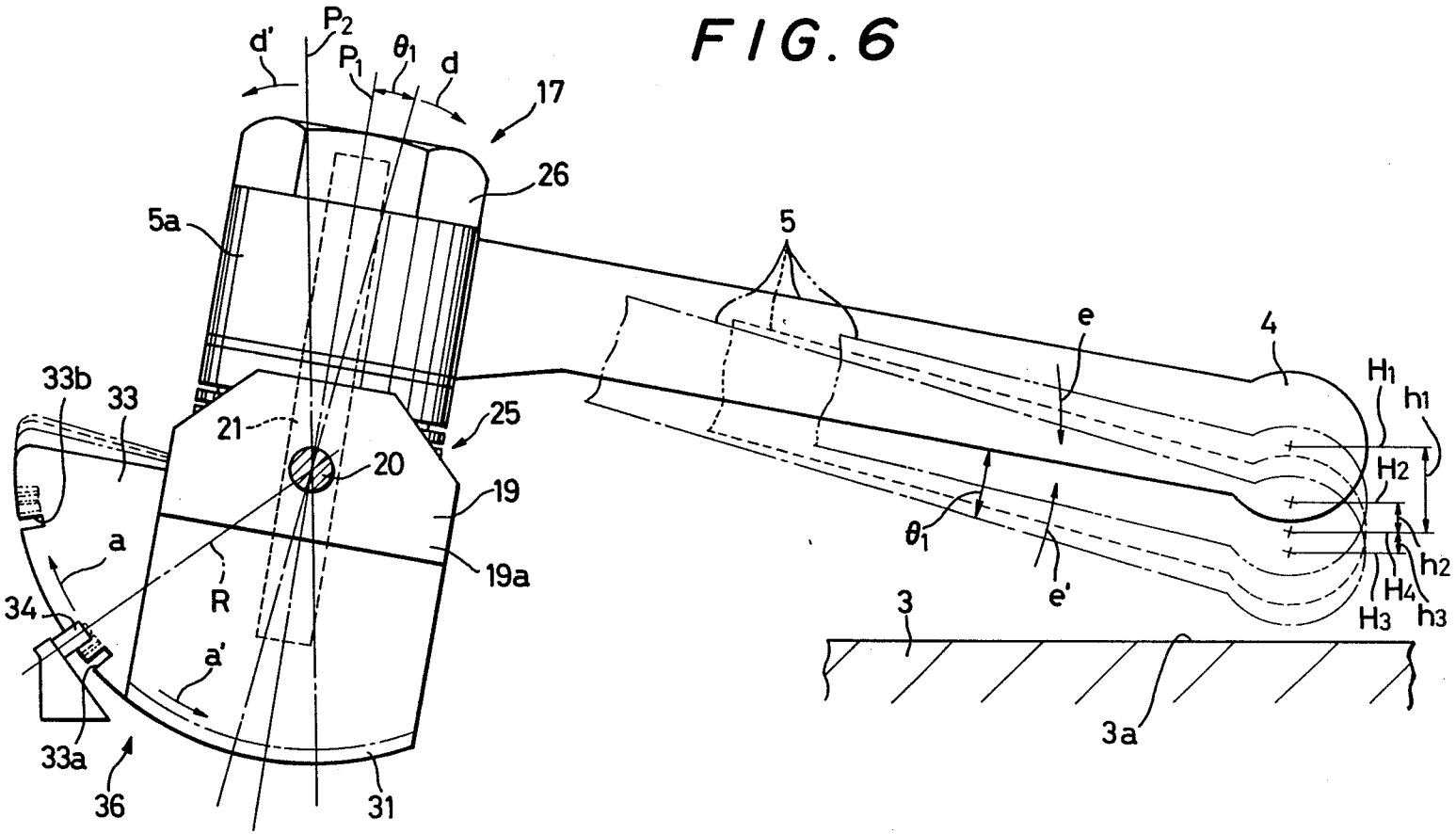
FIG. 6 is a side view of an arm-height adjusting device disposed in the golf simulator of FIG. 1.

As shown in FIGS. 3 to 8, an arm height adjusting-device 36 is designed as follows. For example, when the central line $P_1$ of the vertical shaft 21 is inclined with respect to the vertical line $P_2$, which passes through the center of the horizontal shafts 20, in the direction indicated by the arrow d in FIG. 3, the arm 5, extending through the opening 6 of the body 2 toward the ball striking base 3, is inclined in such a way that its distal end is spaced downwardly away from the horizontal line as indicated in solid lines in FIG. 5. In this state, the tilt angle of the vertical shaft 21 is adjusted as shown in FIG. 6 in the direction indicated by the arrows d and d' within a predetermined angle $\theta_1$. With this operation, the height of the arm 5 is adjusted in the vertical direction indicated by the arrows e end e', while the arm 5 is inclined with its distal end located lower than the other end, as indicated by a solid line, an alternate long and two short dashed line and an alternate long and short dashed line in FIG. 6. In this manner, the height of the ball 4 from a top surface 3*a* of the ball-striking base 3 can be adjusted to three positions, i.e., the highest position $H_1$ for practice of a tee shot with a driver, an intermediate position $H_2$ for a practice of a tee shot with an iron, and the lowest position $H_3$ for practice of a shot on a fairway or putting on a putting green. The arm-height adjusting device 36 comprises the drive means 27 including the stepping motor 28 and the worm gear 29, the optical sensor 34, and a controlling circuit 37 shown in FIG. 7. When the optical sensor 34 detects one slit 33*a* of the slit plate 33, the swingable bed 19 is restored to a swing reference point (reference position) R, and the ball 4 is restored to an original position $H_4$, defined between the intermediate position $H_2$ and the lowest position $H_3$, as indicated by a dotted line in FIG. 6.

Height-adjustment of the arm 5 by means of the arm height adjusting device 36 having the above-described arrangement will be sequentially described below.

Figure 7:
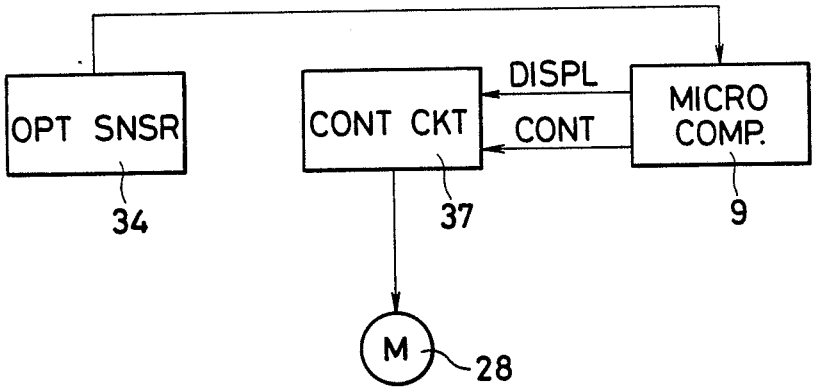
FIG. 7 is a block diagram of a control circuit for controlling the height of the ball-arm, equipped in the arm-height adjusting device of FIG. 6.

When, for example, the ball 4 is to be adjusted to the highest position $H_1$, the controlling circuit 37 is operated by a control signal output from the microcomputer 9 in FIG. 7 so as to drive the stepping motor 28 by pulse control. As a result, the swingable bed 19 is swung in the direction indicated by the arrow a or a' in FIG. 6. When the optical sensor 34 detects the slit 33*a* of the slit plate 33, and the swingable bed 19 is restored to the swing reference point R, the controlling circuit 37 is reset by a control signal output from the microcomputer in FIG. 7, so as to stop the stepping motor 28 and to restore the ball 4 to the original position $H_4$.

Figure 8:
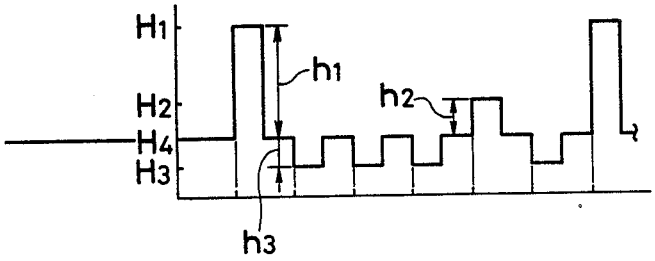
FIG. 8 is a wave form chart showing an operation of adjusting the arm height with the arm-height adjusting device of FIG. 6.

Subsequently, the microcomputer 9 in FIG. 7 outputs a movement designation signal to the controlling circuit 37 so as to set a movement counter of the controlling circuit 37 to a predetermined value. As shown in FIG. 8, the stepping motor 28 is then driven by a pulse signal having a pulse count corresponding to a level difference $h_1$ between the original position $H_4$ and the highest position $H_1$. As a result, the swingable bed 19 is swung from the swing reference point R in the direction indicated by the arrow a' by a predetermined angle, and the height of the arm 5 is adjusted in the direction indicated by the arrow e'. When the ball 4 reaches the highest position $H_1$, the movement counter is reset to stop the stepping motor 28.

The ball 4 can be adjusted to the intermediate position $H_2$ or the lowest position $H_3$ in the same manner as described above. More specifically, the swingable bed 19 is restored to the swing reference point R first so as to restore the ball 4 to the original position $H_4$. Thereafter, as shown in FIG. 8, the stepping motor 28 is driven by a pulse signal having a pulse count corresponding to a level difference $h_2$ between the original position $H_4$ and the intermediate position $H_2$ or the lowest position $H_3$. The swingable bed 19 is swung from the swing reference point R in the direction indicated by the arrow a' or a by a corresponding predetermined angle, thereby adjusting the height of the arm 5 in the direction indicated by the arrow e' or e and moving the ball 4 to the intermediate position $H_2$ or the lowest position $H_3$.

According to this arm height-adjusting device 36, after the swingable bed 19 is restored to the swing reference point R in each adjusting operation, the swingable bed 19 is swung from the swing reference point R by a predetermined angle upon the pulse control of the stepping motor 28, and the height of the arm 5 is adjusted. Therefore, the arm 5 can be very accurately adjusted to a large number of positions in spite of the fact that the arm height-adjusting device 36 uses only the single optical sensor 34.

In addition, since the original position $H_4$, at which the ball 4 is set when the swingable bed 19 is restored to the swing reference point R, is set between the intermediate position $H_2$ and the lowest position $H_3$, height adjustment of the ball 4 can be quickly performed especially between the intermediate position $H_2$ and the lowest position $H_3$. This provides a great convenience because the ball 4 is frequently set at the intermediate position $H_2$ and the lowest position $H_3$ when the player sequentially practices tee shots with a driver and irons, various shots on a fairway and putting on a putting green in each hole while watching the TV monitor 7, as described above. However, the swing reference point R and the original position $H_4$ may be set to arbitrary positions.

Furthermore, according to the arm height adjusting device 36, if a control means for allowing a player to arbitrarily control the predetermined value of the movement counter of the controlling circuit 37 is arranged in the body 2 so as to allow the player to arbitrarily control the pulse count of a pulse signal for controlling the stepping motor 28, the swingable bed 19 can be swung from the swing reference point R by an arbitrary angle, and the arm 5 can be very accurately adjusted to an arbitrary height desired by the player.

Note that in this arm height adjusting device 36, the electromagnetic brake 25 shown in FIG. 3 is kept ON during height adjustment of the arm 5 so as to fix the arm 5 to the swingable bed 19 through the arm holder 22, and is turned off after height adjustment of the arm 5 so as to allow the arm 5 to freely rotate about the vertical shaft 21.

An arm storing device 39 will be described below with reference to FIGS. 3 to 5 and FIG. 9.

The arm storing device 39 is designed to store the arm 5, which is pulled out from the opening 6 of the body 2 to the ball-struck position on the ball striking base 3 so as to be inclined with its distal end located lower than the other end as indicated by a solid line in FIG. 5, by rotating it to a storage position in the body 2 as indicated by an alternate long and short dashed line in FIG. 5. This arm storing device 39 uses the above-described arm height adjusting device 36. A magnet unit 40 is used as needed. As shown in FIGS. 4 and 5, the magnet unit 40 comprises two pairs of right and left magnets 41*a* and 41*b*, and 42*a* and 42*b*, and magnets 43*a* and 43*b* which are fixed to the right and left portions 19*a* of the swingable bed 19 so as to be located near the magnets 41*a* to 42*b*.

A storage operation of the arm by means of the arm storing device 39 having the above-described arrangement will be sequentially described below.

When the arm 5 is pulled out from the body to the ball-struck position as indicated by a solid line in FIG. 5, the axial line $P_1$ of the vertical shaft 21 is inclined in the direction indicated by the arrow d with respect to the vertical line $P_2$ extending through the center of the horizontal shafts 20, as indicated by the solid line in FIG. 3.

Figures 9A, 9B, 9C, 9D:
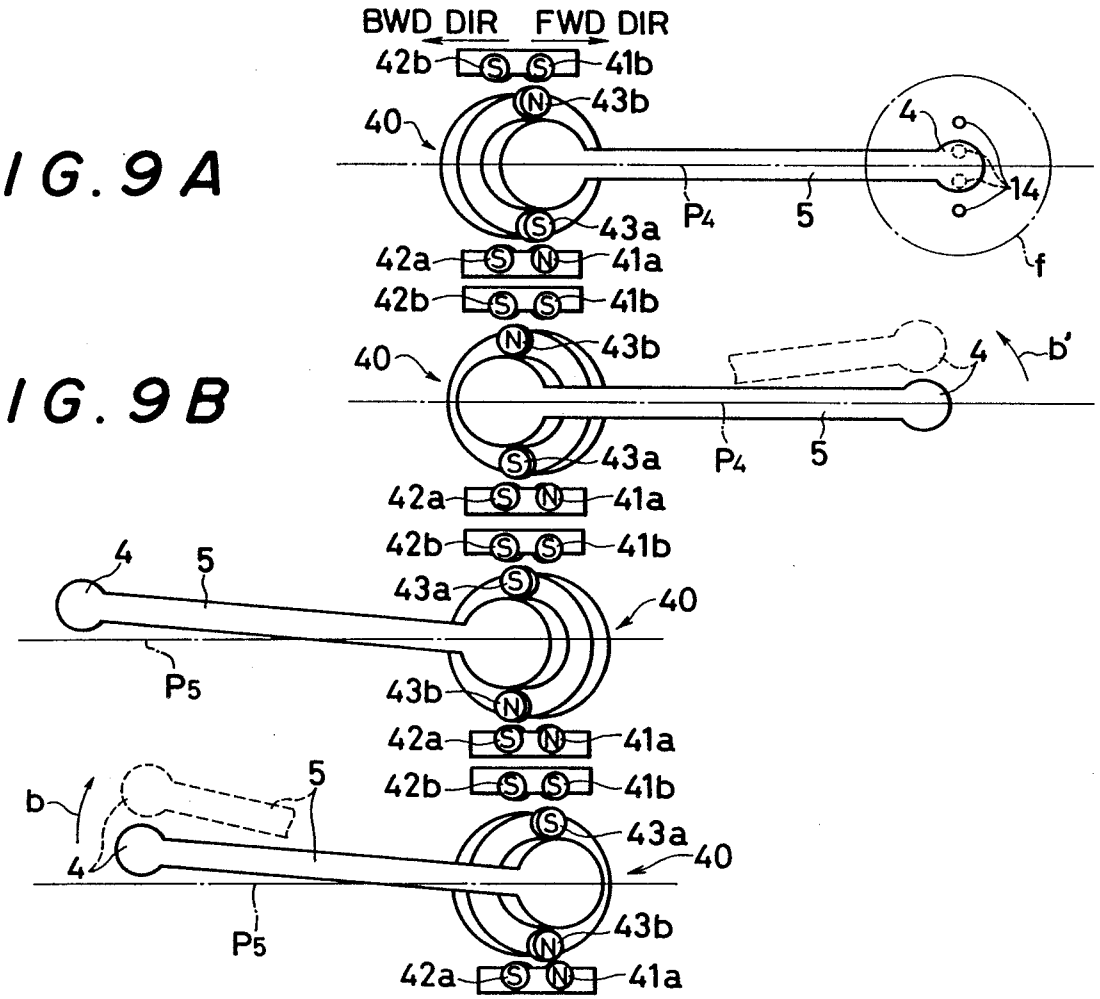
FIGS. 9A to 9B are plan views of the ball-arm supporting device of FIG. 2, when the ball arm is accommodated in the housing of the golf simulator.

In this state, as shown in FIG. 9A, the pair of magnets 43*a* and 43*b* are located near the pair of magnets 41*a* and 41*b*, and the S and N poles of these magnets are attracted to each other to be balanced. As a result, the arm 5 is positioned on a center $P_4$ of the ball-struck position.

In this case, detection light f, which is radiated obliquely downwardly from the light-emitting element 13 arranged immediately above the arm 5, as shown in FIG. 5, passes through a center O of the ball 4 and is radiated on the plurality of photodetection elements 14 which are arranged on the ball striking base 3 so as to be distributed on the right and left sides of the center $P_4$ of the ball-struck position, as shown in FIG. 4. When the positioning of the ball 4 on the center $P_4$ of the ball-struck position is confirmed by the plurality of photodetection elements 14, the electromagnetic brake 25 shown in FIG. 3 is turned on to fix the arm 5 to the swingable bed 19 through the arm holder 22.

After this operation, as described above, the angle of the vertical shaft 21 is adjusted in the directions indicated by the arrows d and d' within the predetermined angle $\theta_1$ by the arm height adjusting device 36, as indicated by the solid line in FIG. 5. As a result, the height of the arm 5 is adjusted in the directions indicated by the arrows e and e' while the arm 5 is inclined at the ball-struck position with its distal end located lower than the other end. Note that, as described above, the electromagnetic brake 25 is turned off after the height adjustment of the arm 5 so as to allow the arm 5 to freely rotate about the vertical shaft 21.

When the arm 5 is to be rotated from the ball-struck position to the storage position and stored, the swingable bed 19 is swinged in the direction indicated by the arrow a' by a large angle by means of the stepping motor 28 through the worm gear 29, so that the axial line $P_1$ of the vertical shaft 21 is inclined in the direction indicated by the arrow d' with respect to the vertical line $P_2$ located outside the predetermined angle $\theta_1$ so as to be adjusted to a position $P_3$, as indicated by alternate long and short dashed lines in FIGS. 3 and 5. Note that in this case, when the optical sensor 34 detects the other slit 33*b* of the slit plate 33, the stepping motor 28 is stopped.

Consequently, the arm 5 is raised in the direction indicated by the arrow e', i.e., above the ball-struck position, and is inclined with its distal end located higher than the other end, as indicated by a dotted line in FIG. 5. The pair of magnets 43*a* and 43*b* are then positioned near the pair of magnets 42*a* and 42*b*, as shown in FIG. 9B. In this state, the S poles of the magnets 42*a* and 43*a* repel each other while the S and N poles of the magnets 42*b* and 43*b* attract each other, thus applying a rotating force to the arm in the direction indicated by the arrow b'. As a result, the arm 5 is slightly rotated from the center $P_4$ of the ball-struck position indicated by a solid line in FIG. 9B in the direction indicated by the arrow b'.

The rotation of the arm 5 is assisted by the rotating force applied by the magnets 42*a*, 42*b*, 43*a* and 43*b*, and the arm 5 is greatly rotated about the vertical shaft 21 by its own weight in the direction indicated by the arrow b'. As a result, the arm 5 is reversed through almost 180° and stored at the storage position indicated by an alternate long and short dashed line in FIG. 5.

When the arm 5 is stored at the storage position, the positions of the pair of magnets 43*a* and 43*b* are reversed so that the arm 5 is stopped at the storage position, slightly displaced from an extension line $P_5$ of the center $P_4$ due to the balance between the attraction of the S and N poles of the magnets 42*a* and 43*b*, the repulsion of the S poles of the magnets 42*b* and 43*a* and the weight of the arm 5.

When the arm 5 is to be pulled out from the storage position to the ball-struck position again, as shown in FIG. 5, the swingable bed 19 is swung by the stepping motor 28 in the direction indicated by the arrow a by a large angle so as to incline the axial line $P_3$ of the vertical shaft 21 toward the vertical line $P_2$. As a result, the arm 5 is raised in the direction indicated by the arrow e, i.e., above the storage position, as indicated by an alternate long and two short dashed line in FIG. 5. In this case, when the optical sensor 34 detects the other slit 33*a* of the slit plate 33, the stepping motor 28 is stopped.

Subsequently, as shown in FIG. 9D, the pair of magnets 43*a* and 43*b* are positioned near the pair of magnets 41*a* and 41*b*, and their N and S poles repel each other, thus applying a rotating force to the arm 5 in the direction indicated by the arrow b. The arm 5 is then biased by this rotating force, and the arm 5 is rotated in the direction indicated by the arrow b about the vertical shaft 21 by its own weight. As a result, the arm 5 is pulled out to the ball-struck position shown in FIG. 9A.

Figure 10:
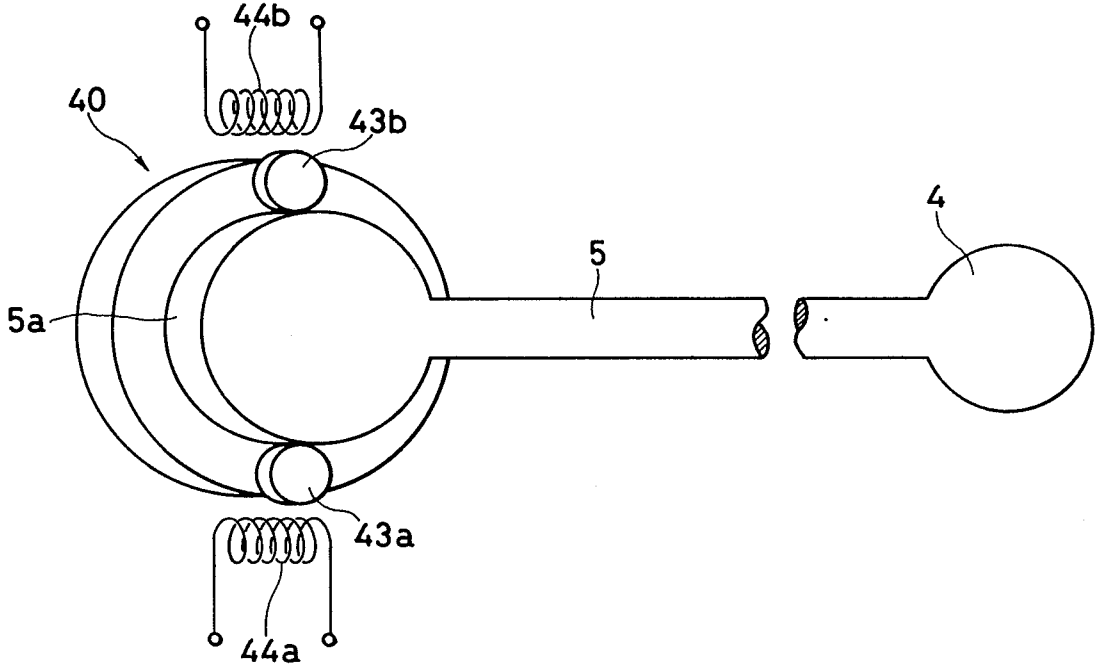
FIG. 10 is a plan view of the ball-arm supporting device of FIG. 2, which has a modified means for accommodating the ball arm in the housing of the golf simulator.

FIG. 10 shows a modification of the magnet unit 40 of the arm storing device 39. In this modification, the pairs of right and left magnets 41*a* and 41*b*, and 42*a* and 42*b* arranged on the bed plate 18, and/or the pair of magnets 43*a* and 43*b* are constituted by electromagnets 44*a* and 44*b*. The polarities of the electromagnets 44*a* and 44*b* are inverted in each operation by switching the directions of currents to be supplied to their coils so that the same operations of the magnets as shown in FIGS. 9A to 9D can be performed. With this arrangement, the number of magnets to be used can be decreased.

Note that the arm storing device 39 need not use the magnet unit 40. For example, when the arm 5 is raised, in the direction indicated by the arrow e', from the ball-struck position indicated by the solid line in FIG. 5 to the position indicated by the dotted line, or the arm 5 is raised, in the direction indicated by the arrow e, from the storage position indicated by the alternate long and short dashed line in FIG. 5 to the position indicated by the alternate long and two short dashed line, the arm 5 can be rotated to the storage position or the ball-struck position by its own weight by slightly biasing the arm 5 in the direction indicated by the arrow b' in FIG. 9B or the arrow b in FIG. 9D, while guiding the arm 5 in contact with a stationary inclined plate or the like.

Figure 11:
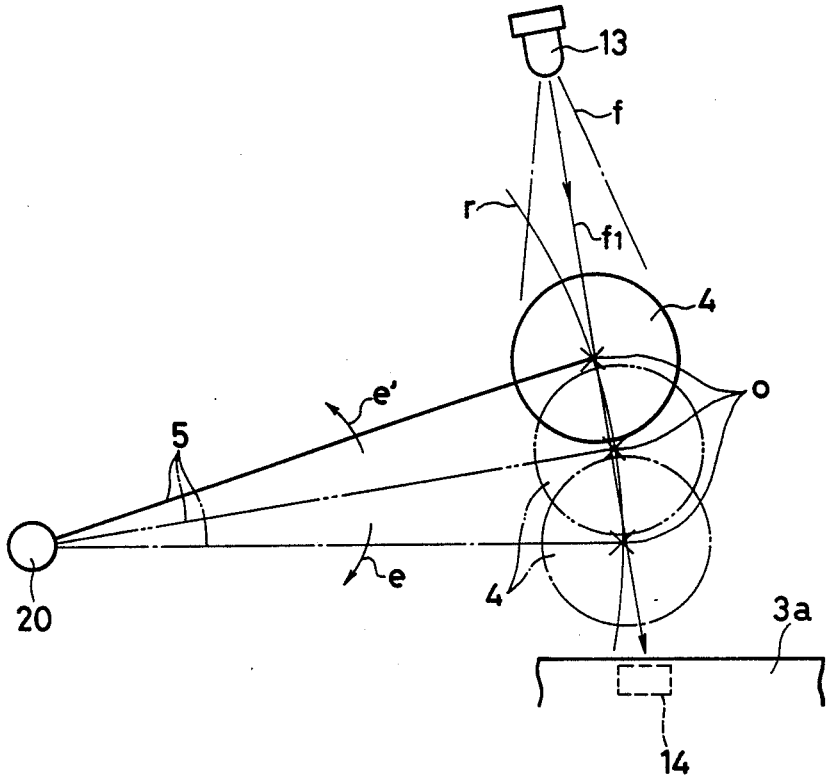
FIGS. 11 and 12 are diagrams showing the relationship between a gold ball and an optical sensor disposed in the golf simulator of FIG. 1.
Figure 12:
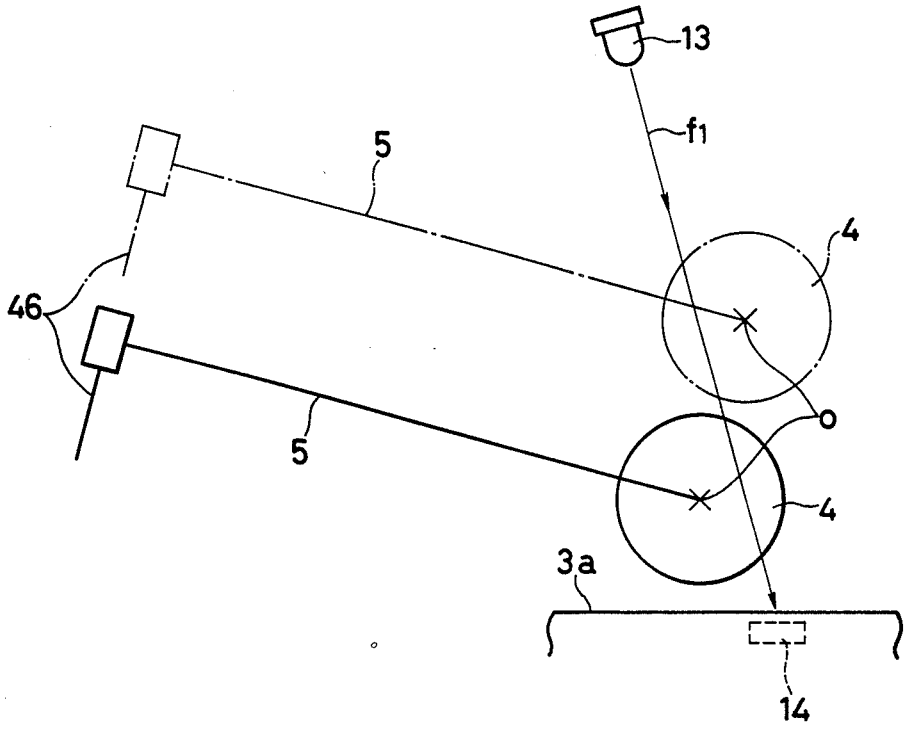

According to the above-described arm height-adjusting device 36, the height of the arm 20 is adjusted by circular movement about the horizontal shafts 20. As shown in FIG. 11, therefore, height adjustment of the center 0 of the ball 4 can be performed on a locus r having an arcuated shape substantially extending along an optical axis $f_1$ of detection light f which is radiated obliquely downwardly from the light-emitting element 13 toward the plurality of photodetection elements 14 on the ball striking base 3 so as to detect the position of the arm 5 at the ball-struck position. For this reason, the center O of the ball 4 whose height is adjusted only slightly deviates from the optical axis $f_1$. In addition, the ball 4 can be positioned, with very high precision, to the highest position $H_1$, the intermediate position $H_2$, and the lowest position $H_3$ shown in FIG. 6. Note that FIG. 12 shows a relationship between the center O of the ball 4 and the oblique optical axis $f_1$ of the light emitting element 13 in a system wherein the height of the ball 4 is adjusted by translation of the arm 5 along a support 46. In this case, since the center O of the ball 4 greatly deviates from the optical axis $f_1$, accurate positioning of the ball at a predetermined height becomes difficult.

The arm supporting device 17 will be described below with reference to FIGS. 13 to 14B. The arm 5 having the ball 4 and the mounted portion 5*a* integrally formed with its both ends is constituted by an elastic member, such as a synthetic resin or hard rubber member. A projection 51 is formed on a portion of an outer surface 22*b* of the arm holder 22, and a recess 52 is formed in a portion of an inner surface 5*b* of the mounted portion 5*a*. An inclined surface 51*a* which is inclined with respect to the axial line $P_1$ of the arm holder 22 is formed on one side surface of the projection 51 in a direction indicated by an arrow g, i.e., the circumferential direction of the arm holder 22, whereas the other side surface 51*b* is formed to be parallel to the axial line $P_1$. Note that the inclined surface 51*a* is inclined to be increased in width toward a bottom portion 51*c*, and the other side surface 51*b* of the projection 51 is formed to be parallel to the axial line $P_1$. In addition, a pair of side surfaces 52*a* and 52*b* of the recess 52 are formed to be parallel to the axial line $P_2$ of the mounted portion 5*a*.

Figure 14A:
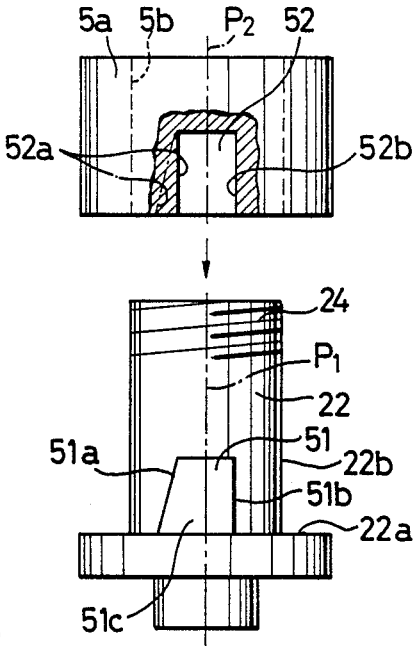
FIGS. 14A and 14B are elevational views, partly broken away and in section, of the ball arm of the ball-arm supporting device of FIG. 13, and an arm holder fitted into the ball arm.
Figure 14B:
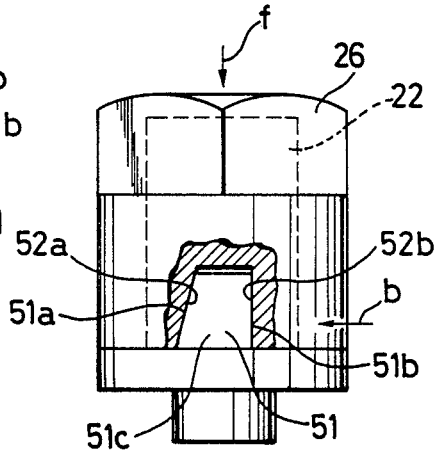

According to the arm supporting device 17, as shown in FIG. 14B, after the projection 51 is fitted in the recess 52 by fitting the mounted portion 5*a* of the arm 5 on the outer surface 22*b* of the arm holder 22 from a direction indicated by an arrow f, the mounted portion 5*a* is fastened on the flange 22 by urging the mounted portion 5*a* from the direction indicated by the arrow f with the nut 26 threadably engaged with the screw 24. As a result, the inclined surface 51*a* of the projection 51 is forcibly inserted in the recess against the elastic force of the mounted portion 5*a* due to a wedge effect, and hence the inclined surface 51*a* elastically deforms one side surface 52*a* of the recess 52, as indicated by an alternate long and short dashed line in FIG. 14A. With this arrangement, the arm 5 can be accurately positioned and mounted on the arm holder 22 with no backlash. Note that, as shown in FIG. 2, since a large shock acting on the ball 14 from the direction indicated by the arrow b when the ball 4 is hit by the golf club 15 can be received by the side surfaces 51*b* and 52*b* of the projection 51 and the recess and 52 which are parallel to the axial lines $P_1$ and $P_2$, respectively, the arm 5 is completely free from a shift in the direction indicated by the arrow b with respect to the arm holder 22 due to this large shock.

Figure 13:
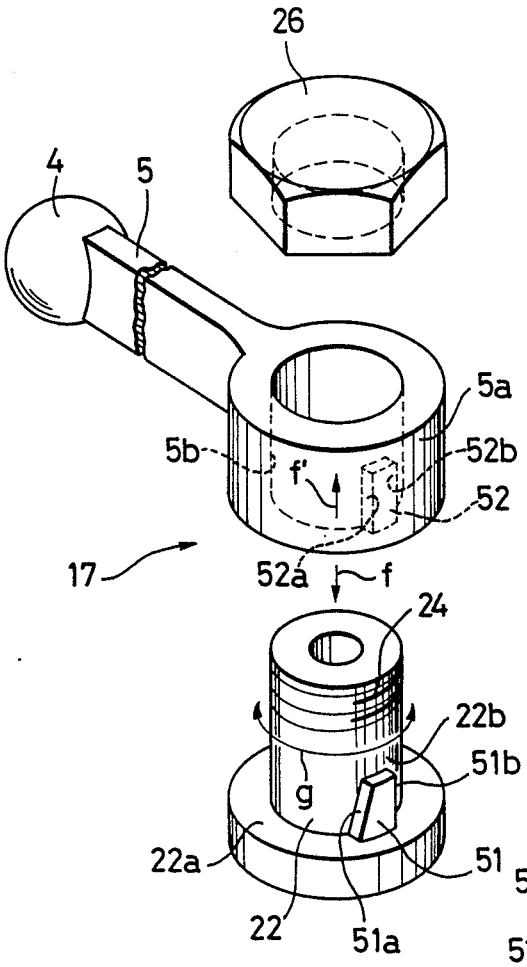
FIG. 13 is an exploded, perspective view of the ball-arm supporting device of FIG. 2.

In addition, as shown in FIG. 13, since the mounted portion 5*a* of the arm 5 can be easily detached from the arm holder 22 in a direction indicated by an arrow f' by only removing the nut 26, the arm holder 5 can be easily replaced with another one.

Figure 15:
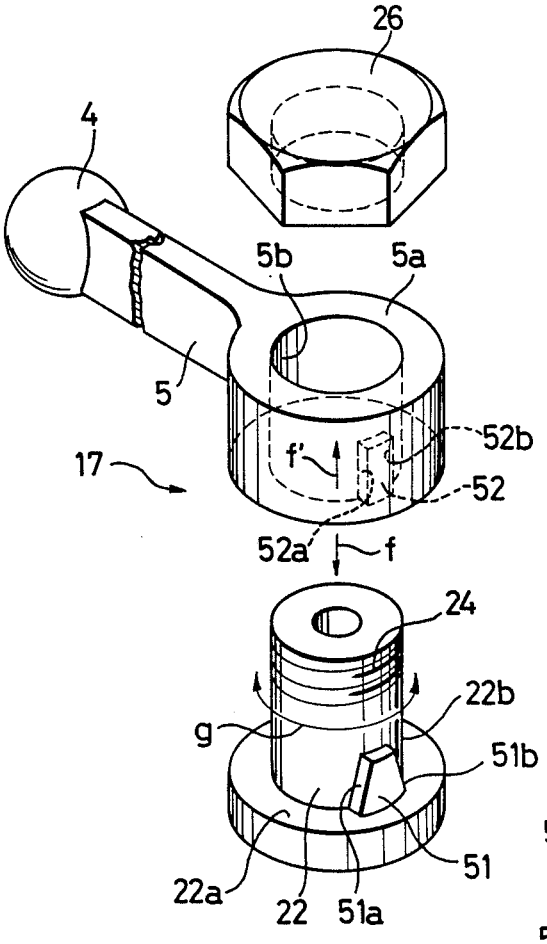
FIG. 15 is an exploded, perspective view of the ball-arm supporting device of FIG. 13, which has a modified means for fitting the arm holder into the ball arm.
Figure 16A:
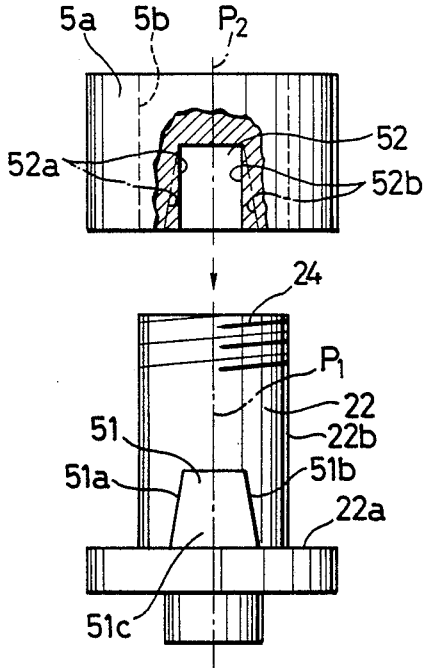
FIGS. 16A and 16B are elevational views, partly broken away and in section, of the ball arm of the ball-arm supporting device of FIG. 15, and the arm holder fitted into the ball arm.
Figure 16B:
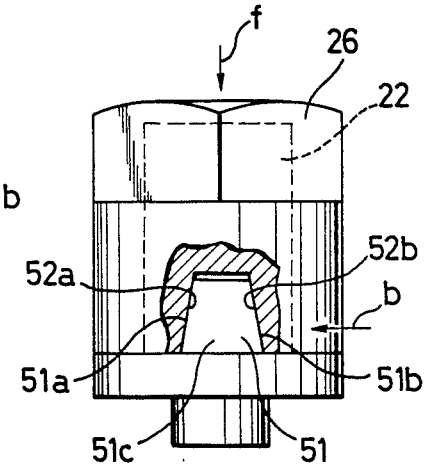
Figure 18A:
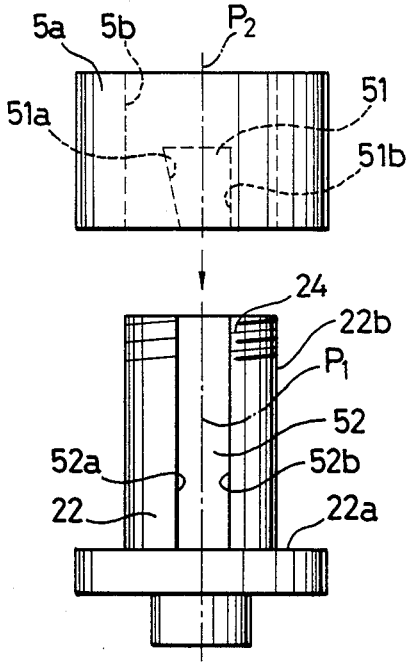
FIGS. 18A and 18B are elevational views, partly broken away and in section, of the ball arm of the ball-arm supporting device of FIG. 17, and the arm holder fitted into the ball arm.
Figure 17:
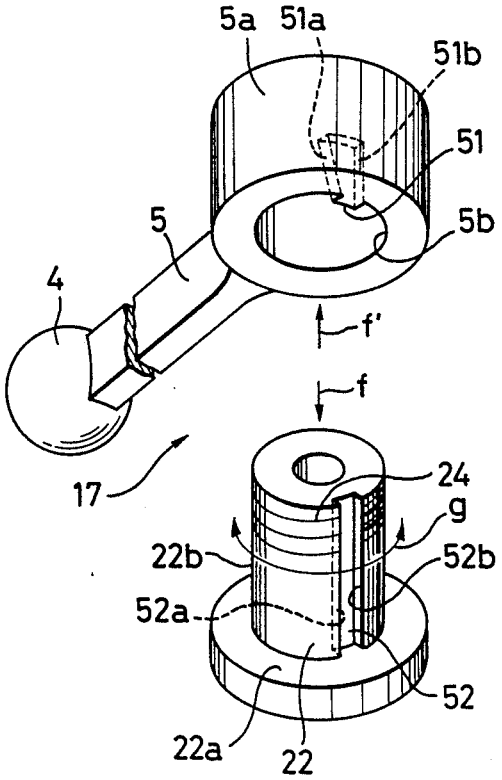
FIG. 17 is an exploded, perspective view of the ball-arm supporting device of FIG. 13, which has another modified means for fitting the arm holder into the ball arm.
Figure 18B:
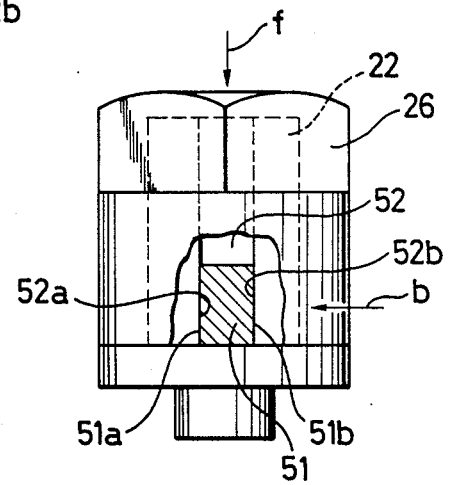

FIGS. 15 to 16B show a modification of the arm supporting device. In this modification, both the side surfaces of a projection 51 are formed into substantially trapezoidal inclined surfaces 51*a* and 51*b*. FIGS. 17 to 18B show another modification wherein a projection 51 is formed on a mounted portion 5*a*, and a recess 52 is formed in an arm holder 22. The same effect as described above can be obtained in both the modifications. However, the recess 52 shown in FIGS. 17 to 18B is formed into a groove.

The embodiment of the present invention has been described above. However, the present invention is not limited to the above-described embodiment. Various effective modifications can be made on the basis of the technical concept of the invention.

In the embodiment, the motor 28 and the worm gear 29 are used as a drive means for the swingable bed 19. However, the present invention is not limited to this, but various other drive means can be used.

Furthermore, in the embodiment, the height of the arm 5 can be adjusted to three levels. However, it can be adjusted to more than three levels.

Moreover, a sensor of any system can be used as the optical sensor 34 for detecting the swing reference point R of the swingable bed 19.

Since the present invention has the above-described arrangement, the following effects can be obtained.

Since the arm 5 is designed to be rotated to the storage position by using the arm height adjusting device 36 and by its own weight, a special motor for storing the arm 5 is not required. Therefore, the structure can be simplified, and the number of parts and assembly steps can be reduced, thus realizing a low-cost golf simulator.

In order to adjust the height of the arm 5, the swingable bed 19 is swung by the motor 28 through the worm gear 29 so as to change the angle of the vertical shaft. Therefore, the height of the arm 5 can be adjusted to more than three levels. This enables a player to practice a wide variety of swings for various types of shots by adjusting the height of the arm to a plurality of levels, e.g., to the highest position for the practice of a tee shot with a driver, the intermediate position for the practice of a tee shot with an iron, and the lowest position for the practice of a shot on a fairway or putting on a putting green.

In the structure in which the swingable bed 19 is swung by the motor 28 through the worm gear 29, the arm 5 can be automatically locked to each height position by using the self-lock mechanism of the worm gear 29. Therefore, no special lock mechanism for locking the arm to each height position is required, and a very simple structure can be realized.

Since the height of the arm is adjusted by changing the angle of the vertical shaft upon the swingable drive of the swingable bed 19, the arm need not be mounted on the distal end side of the vertical shaft on which a large bending moment tends to act when the ball on the distal end of the arm is hit by a golf club, but can be mounted on a portion of the vertical shaft which is located as close to the fixed end as possible. Therefore, damage to the vertical shaft can be prevented, and its service life can be prolonged.

Since only one sensor is required to adjust the height of the arm to a plurality of levels, a very simple arrangement can be realized, and the cost can be reduced.

The arm can be adjusted to a plurality of levels with very high precision. In addition, a player can adjust the arm to an arbitrary height with very high precision.

The system of fitting/pulling the arm on/off from the outer surface of the arm holder from/in the axial direction facilitates replacement of the arm. In addition, since the arm can be positioned and mounted on the arm holder with high precision with no backlash, the ball on the distal end of the arm can always be positioned at a predetermined position with high precision, thereby facilitating the practice of swings for hitting the ball with a golf club, or the like.

What is claimed is:

1. A golf simulator having a housing in which a display and a reproducing device are accommodated, and an arm to the distal end of which a ball is secured, comprising:

a bed plate which supports a horizontal shaft;

a swingable bed rotatable on the horizontal shaft, and having another shaft which makes a right angle with the horizontal shaft, and to which the proximal end of the arm is rotatably secured; and drive means for driving the swingable bed so as to enable the swingable bed to be selectively positioned in either of a first state in which the arm slants toward spacing downwardly from the horizontal line at the distal end thereof due to forward inclination of the shaft of the swingable bed with respect to the vertical line, and slants toward approaching the front side of the housing, and a second state in which the arm slants toward spacing upwardly from the horizontal line at the distal end thereof due to backward inclination of the shaft of the swingable bed with respect to the vertical line.

2. A golf simulator according to claim 1, in which the arm which slants downwardly toward spacing away from the horizontal line at the distal end thereof is selectively positioned, by the drive means, in a first position where the arm has a first angle, a second position where the arm has a second angle, and a third position where the arm has a third angle.

3. A golf simulator according to claim 1, wherein respective magnets arranged in the bed plate and the proximal end of the arm lie adjacently to each other.

4. A golf simulator according to claim 1, wherein the proximal end of the arm has a shape of hollow cylinder in the inner periphery of which a groove is provided;

the shaft of the swingable bed has a projection on the outer periphery thereof; and the shaft is fitted into the proximal end of the arm so as to enable the projection of the shaft to engage with the groove of the arm.

5. A golf simulator according to claim 4, wherein the projection of the shaft is of trapezoidal shape gradually widened in a direction of the arm being inserted.

6. A golf simulator having a housing in which a display and a reproducing device are accommodated, and an arm to the distal end of which a ball is secured, comprising:

a bed plate which supports a horizontal shaft;

a swingable bed rotatable on the horizontal shaft, and having a worm wheel and another shaft which makes a right angle with the horizontal shaft and to which the proximal end of the arm is rotatably secured; and drive means having a worm meshed with the worm wheel, and moving the swingable bed selectively to be in a first state in which the shaft of the swingable bed inclines with respect to the vertical line and toward approaching the front side of the housing, and a second state in which the shaft of the swingable bed inclines with respect to the vertical line and in the reverse of inclination under the first state.

7. A golf simulator having a housing in which a display and a reproducing device are accommodated, and an arm to the distal end of which a ball is secured, comprising:

a bed plate which supports a horizontal shaft;

a swingable bed rotatable on the horizontal shaft, and having a detected element and another shaft which makes a right angle with the horizontal shaft and to which the proximal end of the arm is rotatably secured;

a sensor secured to a portion, near the detected element, of the bed plate; and drive means for driving the swingable bed on a signal from the sensor, so as to enable the shaft of the swingable bed to be positioned selectively in each of three positions—a first position, a second position and a third position—which correspond in turn to three angles—a first angle, a second angle and a third angle—which are formed between the shaft and the vertical line and toward making the shaft approach to the front side of the housing.

8. A golf simulator according to claim 7, wherein the drive mean has a stepping motor.

9. A golf simulator according to claim 8, wherein the drive means moves the swingable bed from its reference position to a predetermined position on a signal from the sensor whenever the ball is struck.

* * * * *